US011772933B2

(12) United States Patent
Bütler et al.

(10) Patent No.: US 11,772,933 B2
(45) Date of Patent: Oct. 3, 2023

(54) BRAKE DEVICE FOR AN ELEVATOR CAR, COMPRISING AN INTEGRATED LOAD MEASURING DEVICE, USE THEREOF IN AN ELEVATOR SYSTEM, AND METHOD

(71) Applicant: Inventio AG, Hergiswil (CH)

(72) Inventors: Erich Bütler, Ebikon (CH); Romeo Lo Jacono, Gravesano (CH); Antonio Perfetto, Ebikon (CH); Gilles Trottmann, Immensee (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 17/755,157

(22) PCT Filed: Oct. 29, 2020

(86) PCT No.: PCT/EP2020/080403
§ 371 (c)(1),
(2) Date: Apr. 22, 2022

(87) PCT Pub. No.: WO2021/084012
PCT Pub. Date: May 6, 2021

(65) Prior Publication Data

US 2022/0363515 A1 Nov. 17, 2022

(30) Foreign Application Priority Data

Oct. 31, 2019 (EP) ..... 19206540

(51) Int. Cl.
*B66B 5/18* (2006.01)
*B66B 1/34* (2006.01)
*B66B 7/04* (2006.01)

(52) U.S. Cl.
CPC ..... *B66B 5/18* (2013.01); *B66B 1/3484* (2013.01); *B66B 7/04* (2013.01)

(58) Field of Classification Search
CPC ..... B66B 5/18; B66B 1/3484; B66B 7/04
See application file for complete search history.

(56) References Cited

U.S. PATENT DOCUMENTS 5,156,239 A * 10/1992 Ericson ..... B66B 1/3476 187/393
6,318,505 B1 * 11/2001 De Angelis ..... B66B 17/34 187/292

(Continued)

FOREIGN PATENT DOCUMENTS

CN 1791546 A 6/2006
CN 1960931 A 5/2007

(Continued)

*Primary Examiner* — Michael A Riegelman
(74) *Attorney, Agent, or Firm* — William J. Clemens; Shumaker, Loop & Kendrick, LLP

(57) ABSTRACT

A braking apparatus, that brakes and measures load changes in an elevator car, includes a brake, a brake holding arrangement holding the brake on the car, a load measuring device measuring a force acting on a force transmission element and a load measuring device holding arrangement holding the load measuring device on the car. The brake can be displaced relative to the car in a force direction generated by the brake and the load measuring device is held on the car fixed relative to the car in the force direction. The force transmission element is operatively connected to the brake to measure a force acting between the brake and the load measuring device due to a relative displacement of the brake relative to the load measuring device. A connecting piece arrangement connects the load measuring device holding arrangement and the brake holding arrangement in an elastically deformable manner.

17 Claims, 3 Drawing Sheets

(56) References Cited

U.S. PATENT DOCUMENTS

| | | | | |
|---|---|---|---|---|
| 6,450,299 | B1 * | 9/2002 | Lysaght | G01G 19/18 187/393 |
| 6,483,047 | B1 * | 11/2002 | Zaharia | G01G 19/18 187/393 |
| 7,604,099 | B2 * | 10/2009 | Kigawa | B66B 5/18 188/161 |
| 8,631,909 | B2 * | 1/2014 | Draper | B66B 5/06 187/373 |
| 9,114,954 | B2 * | 8/2015 | Boschin | B66B 5/02 |
| 9,120,643 | B2 * | 9/2015 | Meierhans | B66B 5/20 |
| 9,856,111 | B1 | 1/2018 | Anderson et al. | |
| 2006/0180406 | A1 * | 8/2006 | Gremaud | B66B 5/16 187/355 |
| 2008/0006486 | A1 * | 1/2008 | Fischer | B66B 5/145 187/393 |
| 2009/0139802 | A1 * | 6/2009 | Maki | B66B 1/3484 73/826 |
| 2022/0363515 | A1 * | 11/2022 | Butler | B66B 17/34 |

FOREIGN PATENT DOCUMENTS

| | | | |
|---|---|---|---|
| DE | 102014213404 | A1 | 1/2016 |
| DE | 202018004562 | U1 | 11/2018 |
| EP | 0151949 | A2 | 8/1985 |
| EP | 1278694 | B1 | 12/2012 |
| JP | H03216477 | A | 9/1991 |
| JP | H07157212 | A | 6/1995 |
| JP | 2014227233 | A | 12/2014 |
| WO | 2016005429 | A1 | 1/2016 |

* cited by examiner

BRAKE DEVICE FOR AN ELEVATOR CAR, COMPRISING AN INTEGRATED LOAD MEASURING DEVICE, USE THEREOF IN AN ELEVATOR SYSTEM, AND METHOD

FIELD

The present invention relates to a braking apparatus for an elevator installation, by means of which apparatus a displaceable elevator car can be braked and load changes caused in the elevator car can be measured. The invention also relates to an elevator installation equipped with such a braking apparatus. The invention also relates to a method for measuring a load acting on an elevator car and to a method for setting a force to be exerted on an elevator car by a drive device in response to a load change in the elevator car using the braking apparatus described herein.

BACKGROUND

In an elevator installation, an elevator car is typically displaced within a vertical elevator shaft between different levels or stories in a building. The elevator car is displaced by means of a drive device that drives support means such as ropes or belts that hold the elevator car, for example. The elevator car is usually guided by guide rails when it is displaced. In order to bring the elevator car to a stop at a desired story, its displacement movements are generally braked by appropriately controlling the drive device.

When people enter or leave the elevator car when it stops at a story, a resulting load change can lead to an elastic change in the length of the support means holding the elevator car. The position of the elevator car relative to the story can thus easily change during the stop at the story. In order to prevent a step being created between a floor of the elevator car and a floor at the story, a change in position of the elevator car has conventionally been compensated for by means of so-called re-leveling, in which the drive device displaces the support means holding the elevator car in a targeted manner in such a way that the change in position of the elevator car is counteracted. However, carrying out such a re-leveling requires complex measures.

Alternatively, it has been proposed to provide a brake directly on the elevator car, with the aid of which the elevator car can be held in a fixed position during a stop at a story. However, the problem can arise here that a load change in the car during the stop leads to an abrupt change in position of the car when the brake is subsequently released due to the changed car load.

Approaches for measuring the load acting on an elevator car have been described. For example, EP 1 278 694 B1 describes load handling means for traction elevators having an integrated load measuring device. An alternative load measuring device for an elevator car is described in EP 0 151 949 A2. A brake load measuring system in which load measuring cells interact with a brake is described in U.S. Pat. No. 6,483,047 B1.

SUMMARY

There may be a need for, inter alia, a braking apparatus by means of which an elevator car of an elevator installation can be braked in an advantageous manner and which is also designed to be able to measure a load change caused in the elevator car. Furthermore, there may be a need for an elevator installation equipped with such a braking apparatus. There may be also a need for an advantageous method for measuring a load acting on an elevator car. Finally, there may be a need for an advantageous method for setting a force exerted on an elevator car by a drive device in response to a load change in the elevator car.

Such a need can be met by the subject matter of the advantageous embodiments that are defined in the following description.

According to a first aspect of the invention, a braking apparatus for braking a displaceable elevator car of an elevator installation and for measuring load changes caused in the elevator car is proposed. The braking apparatus has a brake for braking the elevator car relative to a stationary component of the elevator installation, a brake holding arrangement for holding the brake on the elevator car, a load measuring device having a force transmission element for measuring a force acting on the force transmission element, and a load measuring device holding arrangement for holding the load measuring device on the elevator car. The brake and the brake holding arrangement are configured such that the brake can be held on the elevator car by means of the brake holding arrangement in such a way that the brake can be displaced relative to the elevator car in a force direction generated by the brake. The load measuring device and the load measuring device holding arrangement are configured such that the load measuring device is to be held on the elevator car by means of the load measuring device holding arrangement such that the load measuring device is fixed relative to the elevator car in the force direction generated by the brake. The force transmission element of the load measuring device is operatively connected to the brake in order to be able to measure a force acting between the brake and the load measuring device due to a relative displacement of the brake relative to the load measuring device. The load measuring device holding arrangement and the brake holding arrangement are connected to one another in an elastically deformable manner via a connecting piece arrangement.

According to a second aspect of the invention, an elevator installation which has an elevator car, a guide rail, and a braking apparatus according to an embodiment of the first aspect is described. The elevator car can be displaced along the guide rail. The braking apparatus is held on the elevator car by means of its brake holding arrangement and its load measuring device holding arrangement. The brake of the braking apparatus is configured to cooperate with the guide rail to brake the elevator car.

According to a third aspect of the invention, a method for measuring a load acting on an elevator car is described. The method comprises at least the following steps: (i) activating the brake of a braking apparatus according to an embodiment of the first aspect of the invention held on the elevator car while the elevator car is stationary; and (ii) measuring the load acting on the elevator car using the load measuring device of the braking apparatus.

According to a fourth aspect of the invention, a method for setting a force to be exerted by a drive device on an elevator car in response to a load change in the elevator car is described. The method comprises at least the following steps: (i) measuring the load change using a method according to an embodiment of the third aspect of the invention; and (ii) setting the force exerted by the drive device on the elevator car in such a way that the measured load change is compensated for.

Possible features and advantages of embodiments of the invention can be considered, inter alia and without limiting the invention, to be based upon the concepts and findings described below.

To summarize briefly, a basic concept of the braking apparatus proposed here can be considered that of enabling two functionalities, namely braking the elevator car and measuring a load change caused in the elevator car, with a single device. For this purpose, the braking apparatus is constructed substantially in two parts.

A first part comprises the brake and the brake holding arrangement. The brake is designed to generate forces between the elevator car and a stationary component of the elevator installation, such as a guide rail, with the forces counteracting a movement of the elevator car or the weight thereof in order to brake the movement of the elevator car provided with the brake and/or to keep the elevator car stationary on the stationary component. The brake holding arrangement is designed to attach the brake to the elevator car.

A second part of the braking apparatus comprises the load measuring device and the load measuring device holding arrangement. The load measuring device is designed to measure loads or forces that act on a part of the load measuring device referred to hereinafter as the force transmission element. The load measuring device holding arrangement is configured to attach the load measuring device to the elevator car.

The two parts of the braking apparatus are not only designed for different functionalities, but are also attached to or held on the elevator car in different ways due to the different designs of their respective holding arrangements.

The brake and the brake holding arrangement are designed in such a way that the brake is not secured to the elevator car by means of the brake holding arrangement so as to be absolutely stationary, but can be displaced at least slightly relative to the elevator car, in particular in a direction of the force direction generated by the brake, i.e. typically a direction in which the elevator car moves during its journey or a direction opposite thereto. In other words, the brake holding arrangement, together with the brake fastened thereto, can move within a certain tolerance range or a certain play along the direction of movement of the car relative to the elevator car. The tolerance range can be, for example, a few tenths of a millimeter, in particular, for example, less than 1 mm.

The load measuring device and the load measuring device holding arrangement are designed in such a way that the load measuring device is fixedly secured to the elevator car by means of the load measuring device holding arrangement at least in the force direction generated by the brake, but preferably also in directions transverse to this force direction, i.e. the load measuring device is attached to the elevator car as rigidly and free of play as possible.

Accordingly, the brake held on the elevator car with a certain degree of freedom of movement can move at least slightly relative to the load measuring device fixed rigidly on the elevator car.

The force transmission element of the load measuring device is operatively connected to the brake. If, for example, the elevator car, together with the load measuring device rigidly coupled thereto, moves relative to the brake, which, when activated, is held stationary on the stationary component of the elevator installation, the relative movement of the brake relative to the load measuring device accordingly transmits a force via the force transmission element to a suitable counter-element of the load measuring device. This force can be measured by the load measuring device.

Accordingly, the load measuring device can measure forces which act on the elevator car, in particular in its direction of movement, i.e. typically in the vertical direction. In particular, load changes in the elevator car can be determined using the load measuring device.

However, the load measuring device and the brake should not only be operatively connected to one another via the force transmission element of the load measuring device that connects them. The load measuring device holding arrangement holding the load measuring device and the brake holding arrangement holding the brake should also be connected to one another via a connecting piece arrangement.

This connecting piece arrangement should be configured in such a way that a predominant proportion of the forces acting between the brake and the load measuring device are not transmitted via the force transmission element of the load measuring device but via the connecting piece arrangement. In particular, the connecting piece arrangement should be configured such that, for example, if the force transmission element fails, all of the forces acting between the brake and the load measuring device can be transmitted solely via the connecting piece arrangement without the connecting piece arrangement breaking.

The connecting piece arrangement should be configured such that it interconnects the load measuring device holding arrangement and the brake holding arrangement in such a way that the connecting piece arrangement deforms predominantly elastically, at least when the forces are not excessive, i.e. no irreversible plastic deformation is caused. In particular, as will be explained in more detail below, only elastic deformations should occur on the connecting piece arrangement in the event of forces which approximately correspond to the weight of the elevator car including its maximum permissible payload.

The fact that the load measuring device holding arrangement is connected to the brake holding arrangement via the connecting piece arrangement in an elastically deformable manner means that only a small portion of the forces generated between the brake and the load measuring device when they move relative to one another actually acts on the load measuring device. Accordingly, the load measuring device can be designed to be weaker than it would be if all the forces were transmitted thereto.

Due to the fact that the connecting piece arrangement mainly deforms elastically during the force transmission, the forces proportionately transmitted to the load measuring device can always be substantially proportional to the total forces acting between the brake and the elevator car.

Ultimately, the forces acting on the elevator car or the load changes caused in the elevator car can be measured very precisely and reproducibly with the help of the load measuring device, despite its mechanically relatively weak design.

According to one embodiment, the brake and the brake holding arrangement are configured such that the brake can be held on the elevator car by means of the brake holding arrangement in such a way that the brake can be displaced relative to the elevator car at most up to a predetermined position in the force direction generated by the brake.

In other words, the brake holding arrangement in particular can be designed in such a way that the brake fastened thereto can be attached to the elevator car with a certain amount of play, so that the brake can move easily relative to the elevator car within a tolerance range due to the forces generated when the brake is activated. However, the tolerance range should be clearly limited so that the brake cannot be displaced beyond a maximum predetermined position relative to the elevator car.

For example, one end of the tolerance range can be realized by a mechanical stop provided on the brake holding arrangement, up to which a fixing element rigidly coupled to the elevator car can be displaced relative to the brake holding arrangement, but beyond which the fixing element cannot be moved.

The result of this can be, for example, that the brake can move slightly relative to the elevator car in the case of relatively small forces, for example up to the weight of the elevator car to be held, but, in the case of significantly higher forces, for example those that may occur in the case of emergency braking, the relative movement between the brake and the elevator car is limited to the maximum specified position by the stop provided. As a result, inter alia, the safety of the braking functionality of the proposed braking apparatus can be increased.

In particular, according to one embodiment, the brake holding arrangement can have slots, the longitudinal direction of which extends parallel to the force direction generated by the brake and through which fixing elements held stationary on the elevator car can extend in order to hold the brake holding arrangement on the elevator car.

In other words, two or more slots can be provided in the brake holding arrangement, through which slots fixing elements such as screws or bolts which are fixedly connected to the elevator car can extend.

A slot can be an elongate through-opening which has larger dimensions in a direction parallel to the force direction generated by the brake, i.e. in a length direction, than in a direction transverse thereto, i.e. in a width direction. For example, the dimensions in the width direction can substantially correspond to those of the fixing element extending through the slot, so that there is a form fit in the width direction, whereas the dimensions in the length direction can be at least slightly larger than those of the fixing element, so that the fixing element can move within a tolerance range defined by the slot in the force direction.

Longitudinal ends of the slot act as a mechanical limit for a relative movement of the brake in the longitudinal direction, i.e. the longitudinal ends form a mechanical stop that defines the position up to which the brake and the elevator car can be displaced relative to one another.

Accordingly, in the event of emergency braking, for example, the fixing elements of the elevator car that extend through the slots of the brake holding arrangement can move relative to the brake up to the longitudinal ends of the slots at most. Further displacement is avoided by the form fit which then occurs between the fixing elements and the ends of the slots. Accordingly, the large forces that occur in the event of emergency braking, for example, can be transmitted between the brake and the elevator car via the fixing elements and the brake holding arrangement.

According to one embodiment, the connecting piece arrangement is arranged, dimensioned, and configured in such a way that the connecting piece arrangement deforms substantially only elastically when a force which corresponds to a weight of the elevator car including a maximum permissible payload of the elevator car is transmitted between the brake holding arrangement and the load measuring device holding arrangement.

In other words, the connecting piece arrangement can extend between the brake holding arrangement and the load measuring device holding arrangement in such a way that it only undergoes elastic deformation under forces that typically occur during normal operation of the elevator installation, for example when the elevator car is to be held at a story.

To this end, several different influencing variables can be appropriately selected. For example, the spatial arrangement of the connecting piece arrangement, i.e. in particular its position, orientation, and/or extension direction, can affect its mechanical load-bearing capacity and/or its elastic deformability. In addition, the dimensioning of the connecting piece arrangement, i.e. in particular its cross section, width, length, height, etc., can affect the load-bearing capacity and/or elastic deformability of the connecting piece arrangement. Furthermore, other configuration parameters such as a material used, processing carried out during production, etc., can influence the load-bearing capacity and/or elastic deformability of the connecting piece arrangement. All of these parameters can be suitably selected so that the connecting piece arrangement is configured, for example based on the properties of the elevator car (e.g. its weight and payload) and/or based on the requirements of the entire elevator installation (e.g. safety requirements regarding braking processes), in normal operation of the elevator installation, to react to forces acting thereon only with an elastic deformation, but without plastic deformation.

In particular, according to one embodiment, the connecting piece arrangement can be arranged, dimensioned, and configured in such a way that, when a force which corresponds to a weight of the elevator car including a maximum permissible payload of the elevator car is transmitted between the brake holding arrangement and the load measuring device holding arrangement, the connecting piece arrangement deforms by less than 1 mm, preferably less than 0.5 mm, and more preferably only between 0.05 mm and 0.3 mm, in the force direction generated by the brake.

In other words, the elevator car should be able to move slightly relative to the brake during a braking process. However, the extent of this relative movement should be limited by the specifically selected configuration of the connecting piece arrangement to such an extent that no relative movements of more than 0.5 mm, for example, occur under normal conditions. For many applications, it can even be advantageous if the connecting piece arrangement only allows relative movements of less than 0.2 mm under normal conditions.

In particular, the relative movements that are permissible under normal conditions should be smaller than the tolerance range within which the elevator car can be moved relative to the brake before the elevator car is prevented from further relative movement when a maximum permissible relative movement is reached at a predetermined position, for example by its fixing element hitting the end of the slot. In other words, due to its mechanical configuration, the connecting piece arrangement should preferably only allow relative movements between the elevator car and the brake that are shorter than, for example, the tolerance range specified by the slots of the brake holding arrangement.

According to one embodiment, it can be particularly advantageous if the connecting piece arrangement extends transversely to the force direction generated by the brake, at least in a sub-region.

If the entire length of the connecting piece arrangement between the brake holding arrangement and the load measuring device holding arrangement extended parallel to the force direction generated by the brake, relative displacements between the two holding arrangements could only take place if the length of the connecting piece arrangement itself could change elastically. However, this can be difficult with materials, such as metals, which can be used for the connecting piece arrangement to withstand the forces acting thereon.

The aim is therefore for the connecting piece arrangement to extend transversely to the force direction generated by the brake, at least in a sub-region. The entire length of the connecting piece arrangement can extend linearly and obliquely to the generated force direction. Alternatively, the connecting piece arrangement can have curvatures and extend obliquely to the generated force direction only in sub-regions. In the sub-regions extending obliquely to the force direction, the forces acting during braking can bend the connecting piece arrangement instead of lengthening the entire connecting piece arrangement, so that the two holding arrangements located at the opposite ends of the connecting piece arrangement can be displaced relative to one another in the force direction. With a suitable design of the connecting piece arrangement, in particular with a suitable orientation, suitable cross section, and/or suitable choice of material for the connecting piece arrangement, the local bending of the connecting piece arrangement can take place by elastic deformation.

According to one embodiment, the brake holding arrangement, the load measuring device holding arrangement, and the connecting piece arrangement are designed in one piece with a common part. For example, the brake holding arrangement, the load measuring device holding arrangement, and the connecting piece arrangement may be formed in one piece by a common stamped sheet metal part.

In other words, a single part, such as a metal sheet stamped into a suitable shape, can form both the brake holding arrangement and the load measuring device holding arrangement, as well as the connecting piece arrangement extending between the two.

The entire part can be easy to produce and can be adapted to the forces to be absorbed and transmitted, for example by a suitable choice of a sheet metal, in particular with regard to a thickness of the sheet metal and a material of the sheet metal.

The one-piece design of all regions of such a part makes it possible, for example, to avoid increased wear at weak points that would otherwise occur in a multi-piece part at transitions between segments of the multi-piece part. The one-piece part can also withstand repeated mechanical loads over the long term.

Options for securing the two holding arrangements on the elevator car can be created. In particular, for example, round holes can be provided on the load measuring device holding arrangement in order to be able to fix it to the elevator car using bolts or screws. Slots can be provided on the brake holding arrangement through which bolts or screws can also extend. Both the round holes and the slots can be punched into the sheet metal forming the holding arrangements.

According to one embodiment, the force transmission element can be connected to a counter-element of the load measuring device, which counter-element is fixed to the load measuring device holding arrangement via a strain gauge.

In other words, a strain gauge can be used to measure the forces acting on the load measuring device via the force transmission element. Thus, using the strain gauge, the forces acting between the brake holding arrangement and the load measuring device holding arrangement when the brake is activated, and thus ultimately the forces acting between the activated brake and the elevator car braked thereby, can be measured. Using a strain gauge for this task enables a very robust design of the load measuring device. Furthermore, the strain gauge makes it possible to measure the acting forces very precisely and reproducibly.

According to one embodiment, the load measuring device can be configured to generate an electrical signal that represents the force acting on the force transmission element.

For example, the load measuring device can have a sensor system that can monitor physical parameters that allow the forces acting on the force transmission element to be inferred. The sensor system can generate electrical signals on the basis of the monitored physical parameters. Such electrical signals can be forwarded in a simple manner and, for example, transferred to a controller of the elevator installation or an external monitoring device. Based on the signals, the forces acting on the elevator car can then be inferred. For example, the controller of the elevator installation can thus be informed of the payload currently in the elevator car, so that the controller can control the drive device according to the load.

According to one embodiment, the brake of the braking apparatus described can be configured as a holding brake to hold the elevator car stationary against its weight during a stop. In particular, it can be preferable to additionally configure the brake as a safety brake in order to brake the elevator car in an emergency in the event of a free fall.

In other words, the brake should at least be designed in such a way that it can be used to keep the elevator car stationary on the stationary component of the elevator installation that interacts with the brake, i.e. on a guide rail, for example, while the elevator car is stopped at a story, for example. As such a holding brake, the brake can prevent the elevator car from moving due to load changes when passengers get on or off the elevator car.

In addition, it can be advantageous to design the brake to be even more loadable so that it can also act as a safety brake. In this case, the brake should be configured to be able to generate very large forces between the elevator car and the stationary component, for example in order to be able to brake the elevator car to a standstill over a short distance even in the event that all of the support means holding the elevator break and the elevator car goes into free fall. In order to be able to reliably transmit the very high forces that occur temporarily during such a safety braking process from the brake to the elevator car, the connecting piece arrangement can be configured so as to be stable enough not to break under the large forces, although plastic deformation of the connecting piece arrangement could be permissible in such an exceptional case. The brake holding arrangement itself can also be designed, for example by suitable dimensioning of its slots, and fastened to the elevator car in such a way that it remains reliably held on the elevator car in the event of safety braking.

Therefore, using a braking apparatus according to an embodiment of the first aspect of the invention, the brake of an elevator car on which the brake holding arrangement and the load measuring device holding arrangement of the braking apparatus are held can reliably interact with the guide rail, for example, in order to be able to brake the elevator car in an elevator installation according to an embodiment of the second aspect of the invention.

In addition, the braking apparatus can be used within the scope of a method according to an embodiment of the third aspect of the invention in order to be able to measure the current load acting on the elevator car. In particular, temporary load changes can be measured.

For example, the brake of the braking apparatus can be activated for this purpose while the elevator car is gradually stopped at a story and is stationary. In this case, the brake can, for example, only be activated after the elevator car has been stopped at the story by suitable control of the drive device. Alternatively, the brake can be used to actively brake a movement of the elevator car to a standstill, in which case the brake can then remain activated during the standstill.

The activated brake can prevent the elevator car from moving during a stop at a story, for example when passengers are getting on or off. However, there is a load change in the elevator car as a result of the passengers getting on or off. When using the braking apparatus described herein, the load measuring device thereof can be used to determine such load changes. This can be used, among other things, to make it possible to detect overcrowding of the elevator car and thus an overload.

Alternatively or additionally, according to an embodiment of the fourth aspect of the invention, a load change in the car can be measured using the method described and the information thus obtained can be used to set the force exerted by the drive device on the elevator car in such a way that the measured load change is compensated for.

In other words, the load measuring device can first be used to measure how much heavier or lighter the elevator car becomes as a result of passengers getting on or off. Without appropriate countermeasures, the load change would result in the elevator car abruptly dropping downward or sliding upward when the holding brake is subsequently released, since the elastic support means holding the elevator car would lengthen or shorten as a result of the load change. By measuring the load change in the elevator car with the load measuring device, the drive device can be accordingly controlled in order to be able to suitably set the force acting on the support means even before the holding brake is released, so that when the holding brake is released, the elevator car does not drop down or slide up. The process described can also be referred to as an adjustment to be carried out in advance of the torque to be generated by the drive device (pre-torquing).

According to one embodiment, the method described can be carried out in a particularly simple manner if, before the load change occurs, a force measured by the load measuring device is measured as a reference force. After the brake has been activated and the load in the elevator car has changed, the force exerted on the elevator car can then be set in such a way that the load measuring device measures a force corresponding to the reference force.

In other words, before the brake of the braking apparatus is activated and also before an elevator door is opened and passengers can thus get on and off, for example, a current value of the force measured by the load measuring device can be determined and stored as a reference value. If there is then a load change within the elevator car due to a changed number of passengers, this can be recognized by the load measuring device.

However, it is not necessary to carry out an absolute measurement of the forces generated by the load changes and determine the control signals to be sent to the drive device in order to be able to set the resulting torque in such a way that these load changes are compensated for. Instead, the drive device can simply be controlled so as to successively change its torque. At the same time, changes in current force measured by the load measuring device can be monitored. If this force corresponds to the initially determined reference value, this means that the torque generated by the drive device is set appropriately in order to be able to compensate for the load change that has taken place in the meantime, and therefore the brake can be released without an abrupt change in position of the elevator car.

Furthermore, the device, as well as the methods as described above and below, can be used to ensure that there is no maintenance technician in the car. For example, before switching from normal operation to maintenance operation, the car weight can be measured, and this value can then be compared with a value measured after the maintenance work before switching back to normal operation. If there is a deviation, switching back to normal operation can be prevented. This is particularly advantageous in elevator installations which have no headroom, since it is important under all circumstances to avoid the elevator installation being in normal operation when people are in the shaft. In contrast to a conventional load measurement in the car floor, in which a person is only detected if their weight is on the car floor, but not if the person is standing on the car roof, load measurement at the brake of the car, as described above and below, allows such an application.

It should be noted that some of the possible features and advantages of the invention are described herein with reference to different embodiments of the braking apparatus itself and of the elevator installation equipped with the apparatus, as well a use of this braking apparatus for measuring the load acting on the elevator car or for setting a force to be exerted by the drive device on the elevator car in response to load changes. A person skilled in the art will recognize that the features may be combined, adapted, or exchanged as appropriate in order to arrive at further embodiments of the invention.

Embodiments of the invention will be described below with reference to the attached drawings; neither the drawings nor the description should be considered limiting to the invention.

The drawings are merely schematic and not to scale. Identical reference signs refer to identical or equivalent features in the various drawings.

DETAILED DESCRIPTION

Figure 1:
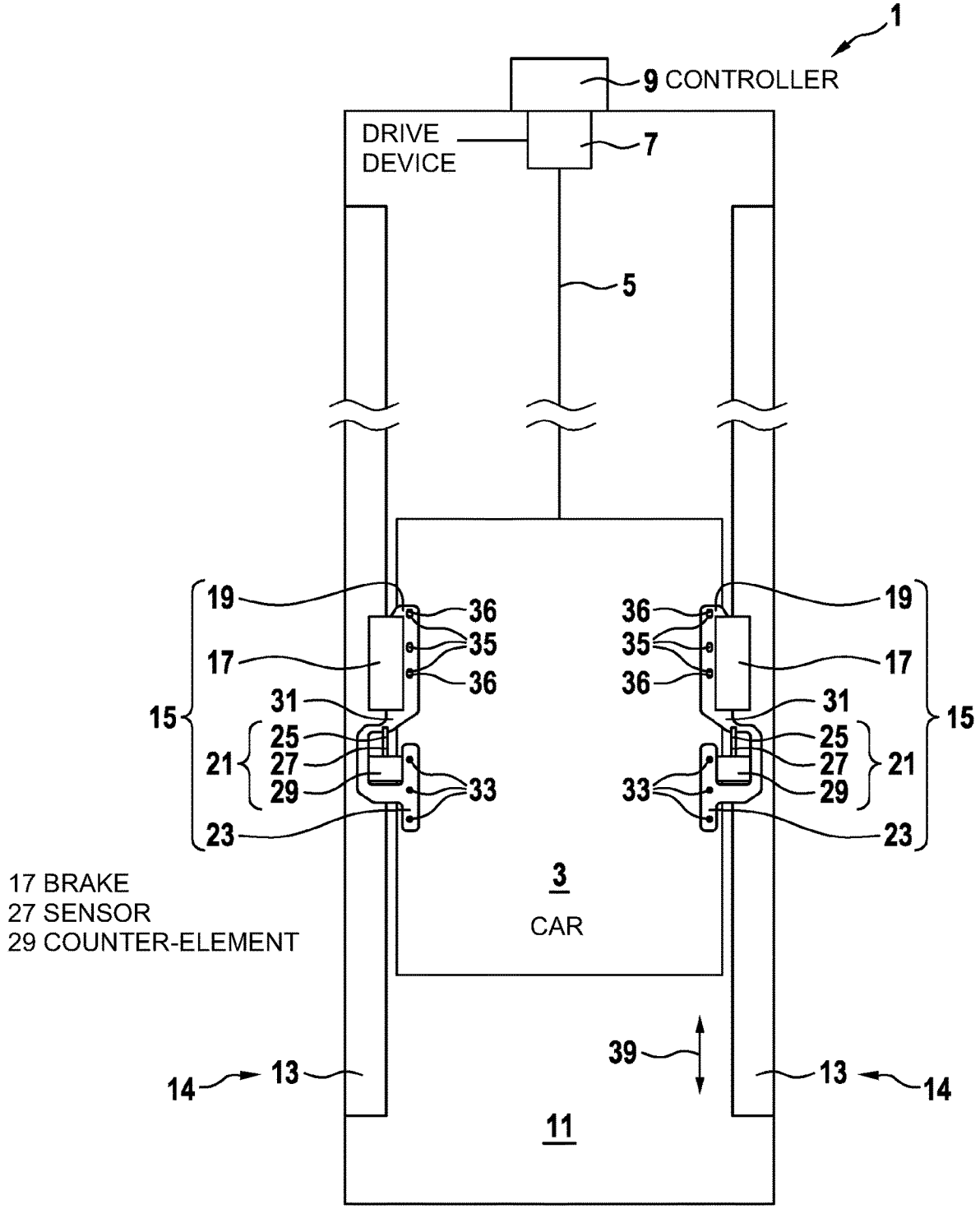
FIG. 1 schematically shows an elevator installation according to an embodiment of the present invention.
Figure 2:
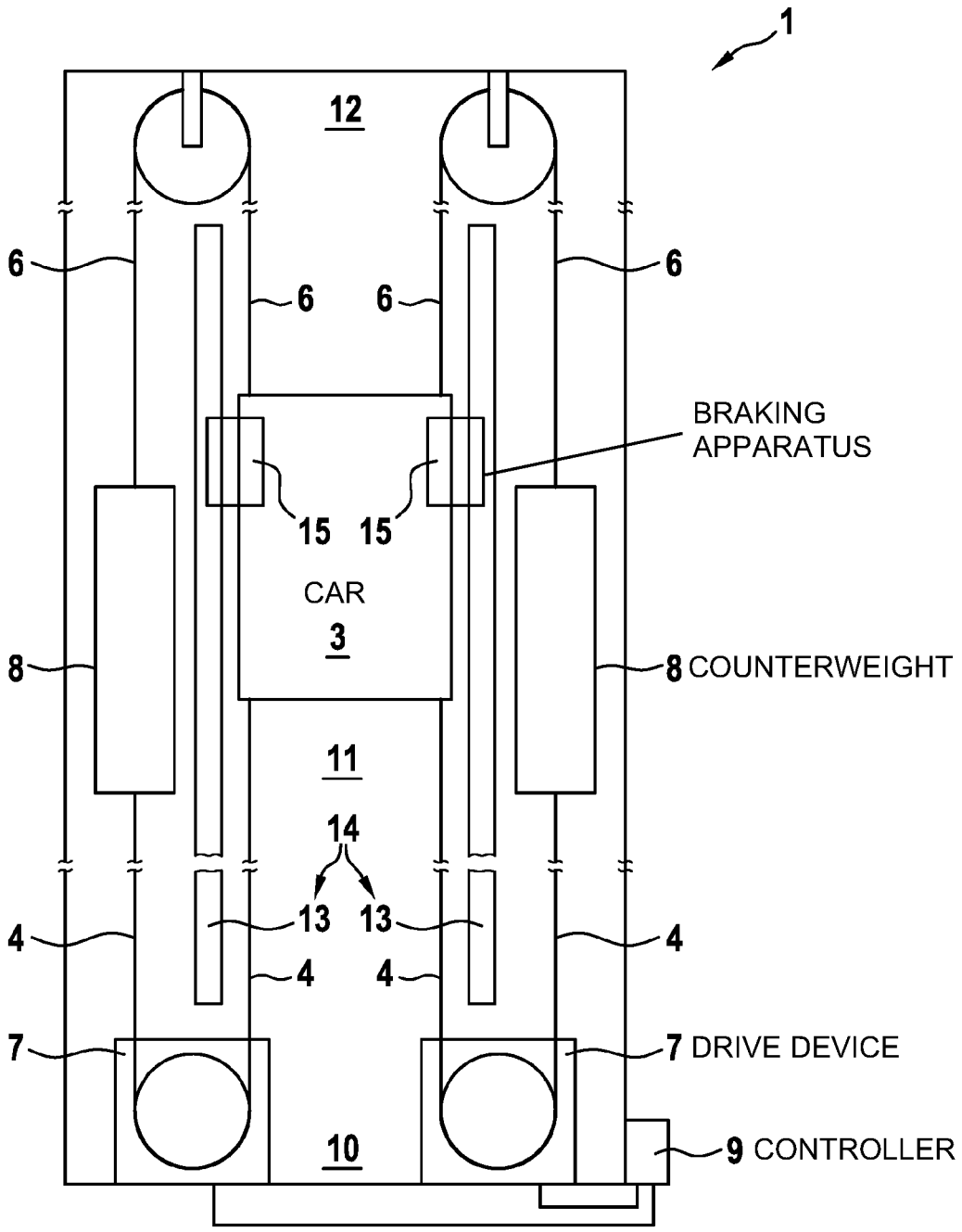
FIG. 2 schematically shows an elevator installation according to an embodiment of the present invention.
Figure 3:
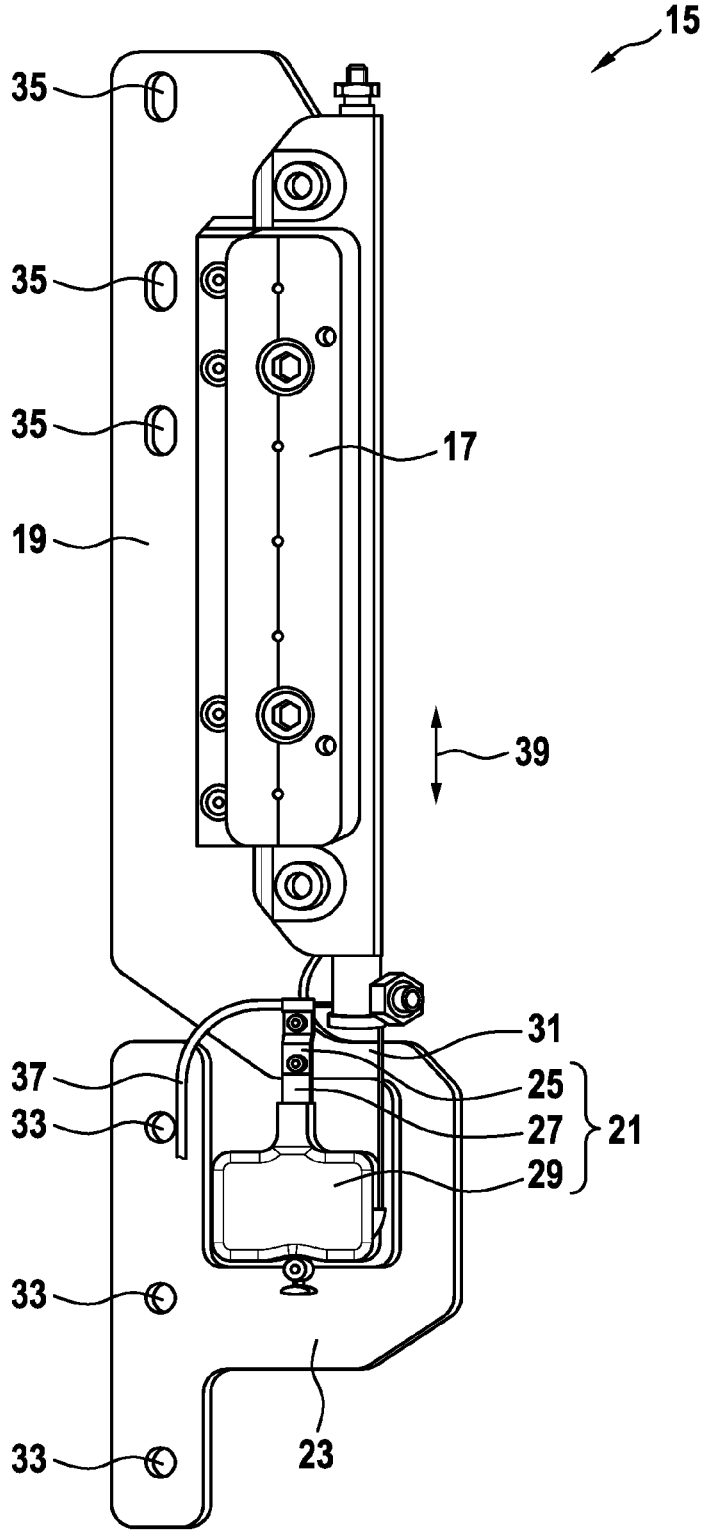
FIG. 3 is a perspective view of a braking apparatus according to an embodiment of the present invention.

FIGS. 1 and 2 show differently designed elevator installations 1 having a braking apparatus 15 according to two embodiments of the present invention. In FIG. 3, a specific embodiment of the braking apparatus 15 is shown larger and with more detail.

The elevator installation 1 shown in FIG. 1 comprises an elevator car 3 which can be held by cable-like or belt-like support means 5, for example, and displaced in an elevator shaft 11. The support means 5 can be displaced by a drive device 7 for this purpose. The drive device 7 is controlled by a controller 9. During its displacement, the elevator car 3 is guided on both sides on at least one guide rail 13 acting as a stationary component 14.

In particular, in order to be able to keep the elevator car 3 stationary during a stop at a desired position, such as at a story, the elevator car 3, after it has been moved to the desired position by means of the drive device 7, can be temporarily fixed with the aid of brakes 17 provided on its braking apparatuses 15 to the stationary guide rails 13. Each of the brakes 17 is fastened to a frame of the elevator car 3, for example, with the aid of brake holding arrangements 19.

At least one of the braking apparatuses 15 also has a load measuring device 21. The load measuring device 21 has a force transmission element 25 and a counter-element 29. Between the force transmission element 25 and the counter-element 29, the load measuring device 21 can have a sensor, for example in the form of a strain gauge 27, with the aid of which a force acting on the load measuring device 21 between the force transmission element 25 thereof and the counter-element 29 thereof can be measured. The load measuring device 21 can, for example, have evaluation electronics in its counter-element 29, by means of which electronics the measurement parameters prevailing at the sensor can be converted into electrical signals. The load measuring device 21 is also fastened to the elevator car 3 via a load measuring device holding arrangement 23.

FIG. 2 shows a further embodiment of an elevator installation 1 according to the invention. In this case, the braking apparatus 15 is shown only schematically and can be configured to be similar in detail to the embodiment shown in FIG. 1. The elevator installation 1 has an elevator car 3 and two counterweights 8. The elevator installation 1 comprises two drive devices 7, which are arranged in a shaft pit 10 of an elevator shaft 11. The traction and suspension are separate in such an embodiment, i.e. two traction support means 4 (below the car) and two suspension support means 6 (above the car) are used.

A braking apparatus 15 as described above and below proves to be particularly advantageous when used in such an elevator installation 1, since braking on the drive devices 7, i.e. via traction support means 4, which are not stressed by the weight of the elevator car 3 can be avoided.

It also proves to be advantageous in such an elevator installation 1 to integrate the load measurement in the braking apparatus 15 provided on the elevator car 3 and not to carry it out in the support means fastenings, as is usually the case. A load measurement via the suspension support means 6 is difficult in such an elevator installation 1 since the forces in the suspension support means 6 are also influenced by an unknown variable due to the prestressing of the traction support means 4. In order to carry out a load measurement at the traction support means 4, a sensor would have to be attached to the traction support means 4 and a sensor would have to be attached to the suspension support means 6. In order to be able to achieve precise measurement results even when the load is unevenly distributed in the elevator car 3, the measurement must be carried out on both sides of the elevator car 3. A total of four sensors would therefore have to be installed.

If the load measurement is at the braking apparatus 15, a reliable measurement can be achieved with only two sensors.

In a further, slightly modified embodiment, the two drive devices are arranged at the top of the shaft head 12 of the elevator shaft 11 (not shown).

In one embodiment, the load measurement may only be at one braking apparatus 15. As can be seen in particular in FIG. 3, the load measuring device holding arrangement 23 and the brake holding arrangement 19 are connected to one another via a connecting piece arrangement 31 so as to be mechanically loadable.

A plurality of slots 35 is formed in the brake holding arrangement 19. A longitudinal direction of the slots 35 is substantially parallel to a force direction 39 in which a force generated by the brake 17 is directed. The force direction 39 substantially corresponds to the direction of movement of the elevator car 3 and is therefore substantially vertical. The length of the slots 35 can, for example, be about 0.5 mm greater than their width. The plurality of slots 35 are arranged linearly one above the other in the force direction 39. A fixing element 36 (FIG. 1), for example in the form of a bolt or a screw, can extend through each of the slots 35 and can be fixed to the elevator car 3 or to the frame thereof. The brake holding arrangement 19 can thus be held on the elevator car 3 via the fixing elements 36, but can be vertically moved slightly relative to the elevator car 3 by displacing the fixing elements 36 within the slots 35.

The load measuring device holding arrangement 23 has a plurality of round holes 33. Fixing elements (not shown) can in turn extend through the round holes 33, via which elements the load measuring device holding arrangement 23 can be fastened to the elevator car 3 or to the frame thereof substantially without play.

Accordingly, the brake 17 held by the brake holding arrangement 19 can be displaced slightly in the force direction 39 relative to the load measuring device holding arrangement 23 or relative to the elevator car 3 when a force in the force direction 39 is generated by activating the brake 17.

Such a relative displacement causes, inter alia, a deformation of the connecting piece arrangement 31. The connecting piece arrangement 31 is arranged, dimensioned, and configured in such a way that this deformation is usually elastic, at least as long as the brake 17 only generates the forces required to hold the elevator car 3 and the payload thereof, for example when stopping at a story.

However, the relative displacements between the brake 17 and the car 3 caused when the brake 17 is activated can also be used to make it possible to use the load measuring device 21 to measure loads or load changes currently acting on the elevator car 3.

For this purpose, in the example shown, the counter-element 29 of the load measuring device 21 is fixedly connected, for example screwed, to the load measuring device holding arrangement 23. The force transmission element 25 is coupled, for example, to a part of the brake holding arrangement 19 and is thus operatively connected to the brake 17. Electronics (not shown) provided in counter-element 29, for example, can be used e.g. to measure mechanical stresses that occur in the strain gauge 27 arranged between the force transmission element 25 and the counter-element 29 due to the forces generated by the relative displacement. The electronics can then produce an electrical signal which can act as a measure of the force to which the load measuring device 21 is subjected.

It is therefore possible not only to use the brake 17 of the braking apparatus 15 to brake the elevator car 3, but also to use the load measuring device 21 of the braking apparatus to measure a load acting on the elevator car 3.

During operation of the elevator installation 1, the elevator car 3 can be transported to a story by means of the drive device 7, for example. In order to prevent the elevator car 3 from subsequently moving up or down when passengers get on and off due to the resulting load changes, the brake 17 of the braking apparatus 15 can be activated, for example via a control line 37, before the car doors are opened.

A force currently acting between the brake 17 and the elevator car 3 can be measured using the load measuring device 21 in advance or at least before a load change can occur in the elevator car 3, i.e. before the car door is opened, for example. This force can usually be zero, for example, particularly if the elevator car 3 was braked to a standstill exclusively by controlling the drive device 7 and the brake 17 was only activated afterwards. However, if the brake 17 was also used to decelerate the movement of the elevator car 3, this force can also have a value other than zero. This previously measured force can be stored as a reference value.

As soon as load changes occur when passengers subsequently get in and out of the car, they can be measured using the load measuring device 21. The information about the measured load changes can be used to vary the forces exerted on the elevator car 7 via the support means 5 by controlling the drive device 7 in a targeted manner in such a way that the load changes which have occurred in the meantime are compensated for.

Alternatively, the drive device 7 can change the forces acting on the elevator car 3 via the support means 5 until the force currently measured by the load measuring device 21 matches the previously determined reference value again.

It can be ensured in both cases that changed load conditions within the elevator car 3 are compensated for by suitably tensioning or relaxing the support means 5 using the drive device 7 in such a way that the entire elevator car 3, including the payload thereof, which has changed in the meantime, is held by the support means 5 again. In this state, the brake 17 can be released without the elevator car 3 then moving abruptly. This also applies to the embodiment shown in FIG. 2.

Finally, it should be noted that terms such as "comprising," "having," etc. do not preclude other elements or steps, and terms such as "a" or "an" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A braking apparatus for braking a displaceable elevator car of an elevator installation and for measuring load changes caused in the elevator car, the braking apparatus comprising:

a brake adapted to brake the elevator car relative to a stationary component of the elevator installation;

a brake holding arrangement adapted to hold the brake on the elevator car;

a load measuring device having a force transmission element measuring a force acting on the force transmission element;

a load measuring device holding arrangement adapted to hold the load measuring device on the elevator car;

wherein the brake and the brake holding arrangement are held on the elevator car by the brake holding arrangement such that the brake can be displaced relative to the elevator car in a force direction generated by actuation of the brake;

wherein the load measuring device and the load measuring device holding arrangement are held on the elevator car by the load measuring device holding arrangement such that the load measuring device is fixed relative to the elevator car in the force direction;

wherein the force transmission element is operatively connected to the brake to measure a force acting between the brake and the load measuring device due to a displacement of the brake relative to the load measuring device; and wherein the load measuring device holding arrangement and the brake holding arrangement are connected to one another in an elastically deformable manner via a connecting piece arrangement.

2. The braking apparatus according to claim 1 wherein the brake can be displaced relative to the elevator car up to a predetermined position in the force direction.

3. The braking apparatus according to claim 1 wherein the brake holding arrangement has slots formed therein, a longitudinal direction of the slots extending parallel to the force direction, and fixing elements held stationary on the elevator car extend through the slots to hold the brake holding arrangement on the elevator car.

4. The braking apparatus according to claim 1 wherein the connecting piece arrangement deforms elastically when a force corresponding to a weight of the elevator car including a maximum permissible payload of the elevator car is transmitted between the brake holding arrangement and the load measuring device holding arrangement.

5. The braking apparatus according to claim 1 wherein the connecting piece arrangement deforms by less than 1 mm in the force direction when a force corresponding to a weight of the elevator car including a maximum permissible payload of the elevator car is transmitted between the brake holding arrangement and the load measuring device holding arrangement.

6. The braking apparatus according to claim 1 wherein the connecting piece arrangement extends transversely to the force direction at least in a sub-region of the connecting piece arrangement.

7. The braking apparatus according to claim 1 wherein the brake holding arrangement, the load measuring device holding arrangement and the connecting piece arrangement are formed in one piece by a common part.

8. The braking apparatus according to claim 7 wherein the one piece common part is formed of stamped sheet metal.

9. The braking apparatus according to claim 1 wherein the force transmission element is connected via a strain gauge to a counter-element of the load measuring device, the counter-element being fixed to the load measuring device holding arrangement.

10. The braking apparatus according to claim 1 wherein the load measuring device generates an electrical signal representing the force acting on the force transmission element.

11. The braking apparatus according to claim 1 wherein the brake is a holding brake for holding the elevator car stationary against its weight during a stop.

12. The braking apparatus according to claim 11 wherein the brake also is a safety brake for braking the elevator car in an emergency to stop a free fall of the elevator car.

13. An elevator installation comprising:

an elevator car;

a guide rail guiding the elevator car, the elevator car being displaceable along the guide rail;

the braking apparatus according to claim 1;

wherein the braking apparatus is held on the elevator car by the brake holding arrangement thereof and the load measuring device holding arrangement thereof; and wherein the brake interacts with the guide rail to brake the elevator car.

14. A method for measuring a load acting on an elevator car, the method comprising the steps of:

providing the braking apparatus according to claim 1 on the elevator car;

activating the brake of the braking apparatus while the elevator car is stationary; and measuring a load acting on the elevator car using the load measuring device of the braking apparatus.

15. A method for setting a force to be exerted by a drive device on an elevator car in response to a load change in the elevator car, the method comprising the steps of:

performing the method according to claim 14 to measure a load change in the load acting on the elevator car; and setting the force exerted by the drive device on the elevator car to compensate for the measured load change.

16. The method according to claim 15 including further steps of, before the load change occurs, measuring the force acting between the brake and the load measuring device by the load measuring device as a reference force; and after activation of the brake and after the load change has occurred, setting the force exerted by the drive on the elevator car such the load measuring device measures a force corresponding to the reference force.

17. A braking apparatus for braking a displaceable elevator car of an elevator installation and for measuring load changes caused in the elevator car, the braking apparatus comprising:

a brake adapted to brake the elevator car relative to a stationary component of the elevator installation;

a brake holding arrangement adapted to hold the brake on the elevator car;

a load measuring device having a force transmission element measuring a force acting on the force transmission element;

a load measuring device holding arrangement adapted to hold the load measuring device on the elevator car;

wherein the brake and the brake holding arrangement are held on the elevator car by the brake holding arrangement such that the brake can be displaced relative to the elevator car up to a predetermined position in a force direction generated by actuation of the brake;

wherein the load measuring device and the load measuring device holding arrangement are held on the elevator car by the load measuring device holding arrangement such that the load measuring device is fixed relative to the elevator car in the force direction;

wherein the force transmission element is operatively connected to the brake to measure a force acting between the brake and the load measuring device due to a displacement of the brake relative to the load measuring device, the load measuring device generating an electrical signal representing the force acting on the force transmission element; and wherein the load measuring device holding arrangement and the brake holding arrangement are connected to one another in an elastically deformable manner via a connecting piece arrangement, the connecting piece arrangement deforming elastically when a force corresponding to a weight of the elevator car including a maximum permissible payload of the elevator car is transmitted between the brake holding arrangement and the load measuring device holding arrangement, and the connecting piece arrangement extends transversely to the force direction at least in a sub-region of the connecting piece arrangement.

* * * * *